United States Patent [19]

Weiss

[11] 4,062,066

[45] Dec. 13, 1977

[54] APPAREL BELT WITH CONCEALED POCKET

[75] Inventor: Adolph D. Weiss, Fort Worth, Tex.

[73] Assignee: Hickok Manufacturing Co., Inc., Arlington, Tex.

[21] Appl. No.: 732,584

[22] Filed: Oct. 15, 1976

[51] Int. Cl.[2] ..... A41F 9/00

[52] U.S. Cl. ..... 2/322; 224/5 A

[58] Field of Search ..... 224/5 A, 26 C; 2/321, 2/322

[56] References Cited

U.S. PATENT DOCUMENTS

| | | | |
|---|---|---|---|
| 2,048,498 | 7/1936 | Foster | 224/5 A |
| 2,156,373 | 5/1939 | Craighead | 224/26 C |

*Primary Examiner*—Werner H. Schroeder
*Assistant Examiner*—Doris L. Troutman
*Attorney, Agent, or Firm*—Robert A. Felsman

[57] ABSTRACT

An apparel belt with inner and outer plies, having an opening in the inner ply to provide access to the space between the plies for placing articles, such as money. The belt has a doubled-back portion at one end defining a loop for retaining a buckle. The opening lies across from the doubled-back portion and is covered by it when the doubled-back portion is fastened to the inner layer. The opening is arcuate, with a flap being defined to provide access to the ends of the articles placed therein. Releasable snap fasteners fasten the doubled-back portion to the inner ply to cover the opening and flap.

4 Claims, 3 Drawing Figures

APPAREL BELT WITH CONCEALED POCKET

BACKGROUND OF THE INVENTION

1. Field of the Invention

This invention relates in general to apparel belts and in particular to an apparel belt with a concealed pocket.

2. Description of the Prior Art

Belts having concealed pockets for concealing money or small valuable objects are known in the patented prior art. Certain of these patents teach separate pockets sewed to the inner side of a belt, thus are expensive to manufacture and may create bulges and discomfort. Another type utilizes space between inner and outer plies, such as in U.S. Pat. No. 2,025,886 issued to Nordstrom. In that type, an additional ply over the normal double ply is required, and ready access to the pocket is not provided. In the patent issued to Foster, U.S. Pat. No. 2,048,498, a pocket is shown between the plies, with access provided through an opening in the outer ply. However the pocket is concealed only if the free end of the belt covers the aperture, which requires proper sizing. Moreover articles are retained only by friction fit in the pocket, thus may fall from the pocket when the belt is loosened or removed.

SUMMARY OF THE INVENTION

It is accordingly a general object of this invention to provide an improved belt with a concealed pocket for retaining money and small articles.

It is a further object of this invention to provide an improved belt with a concealed pocket formed integrally with the belt that does not create a bulge and is readily accessible from the inner side.

It is a further object of this invention to provide an improved belt with a concealed pocket on the inner side and with means to retain articles within even though the belt is removed.

In accordance with these objects, a belt is provided with an inner and outer ply and a slit on the inner ply to provide access to the space between the inner and outer plies. The belt is of the type having a doubled-back portion adjacent one end for retaining a buckle. The slit and its flap defined by the bounds of the slit are covered by the doubled-back portion when the doubled-back portion is fastened to the belt. Releasable snaps are located on the doubled-back portion and on the inner ply to release the doubled-back portion to provide access to the article in the interior space behind the flap.

DESCRIPTION OF THE PREFERRED EMBODIMENT

Figure 1:
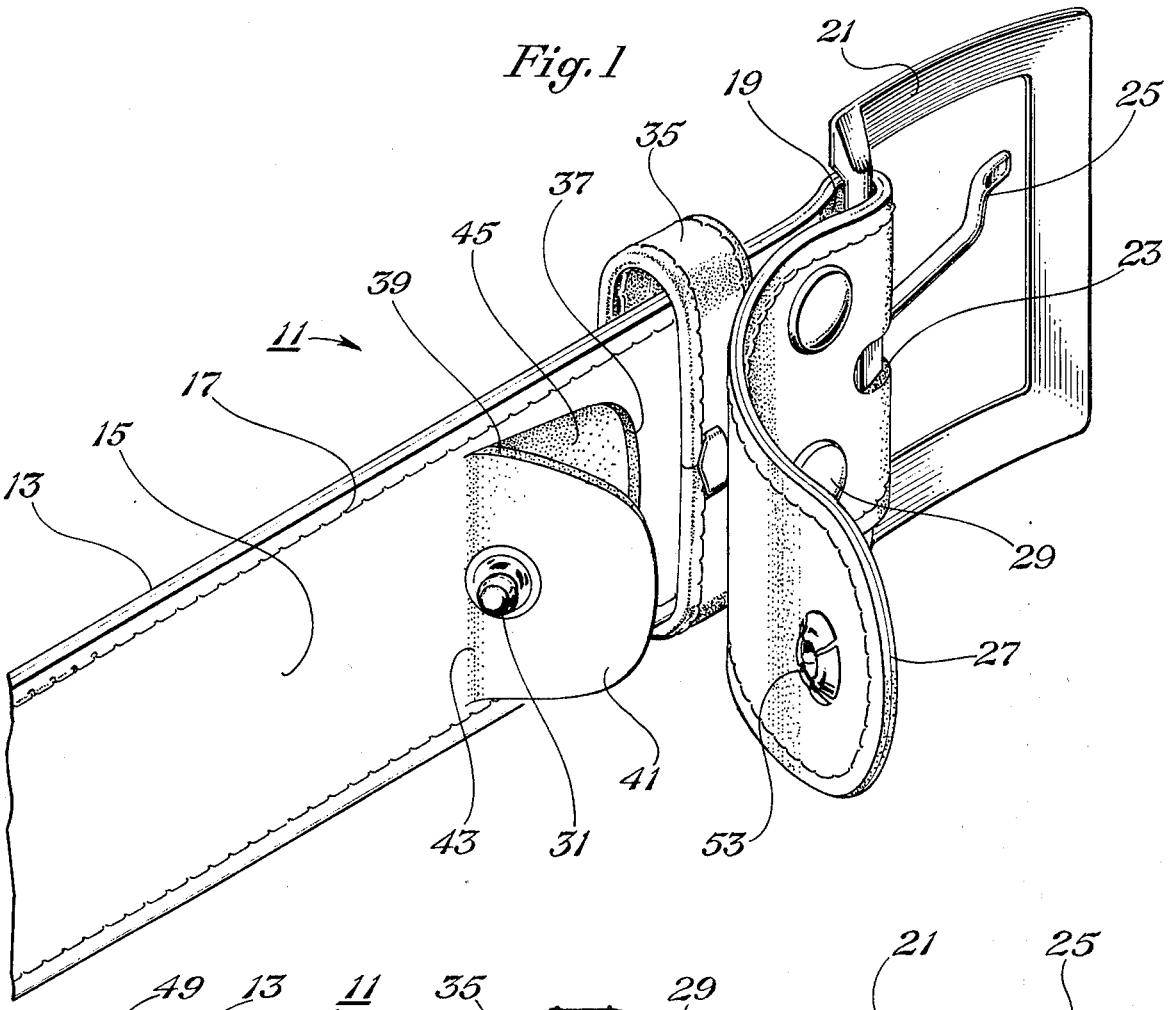
FIG. 1 is a perspective view of a portion of a belt constructed in accordance with this invention.
Figure 2:
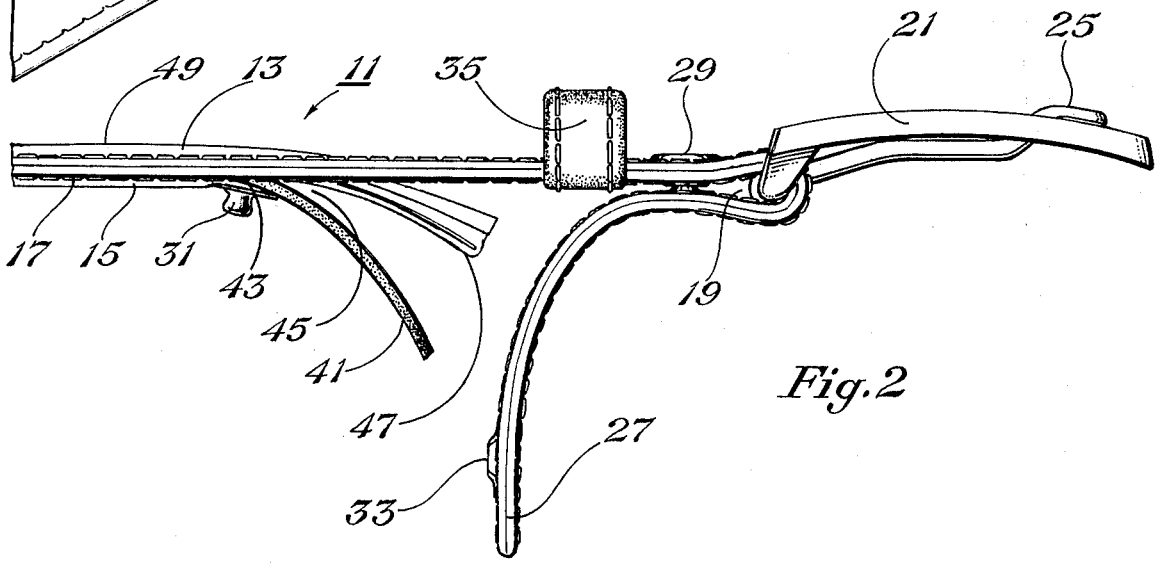
FIG. 2 is a side elevational view of the belt shown in FIG. 1.

Referring to the figures, belt 11 is of the type having an outer ply 13 and an inner ply 15, normally of leather or leather-like material. The plies 13, 15 extend the length of the belt and are sewed together along the sides by stitches 17. The inner ply 15 is on the inside of the belt 11.

At one end, both plies 13, 15 of the belt 11 are doubled-back a selected distance, defining a loop 19 for retaining a buckle 21. Frequently the belt has an aperture 23 centered in loop 19 for the tongue 25 of a buckle 21. The doubled-back portion 27 of belt 11 contains releasable snap fasteners 29 directly behind the loop 19 to retain the buckle 21. Another fastener means, also of a releasable snap fastener type, includes a receptacle 33 near the end of the doubled-back portion and a snap 31 directly across from it. A loop 35 for receiving the free end (not shown) of the belt may be stapled or stitched between fastener 29 and fastener 31, 33.

Figure 3:
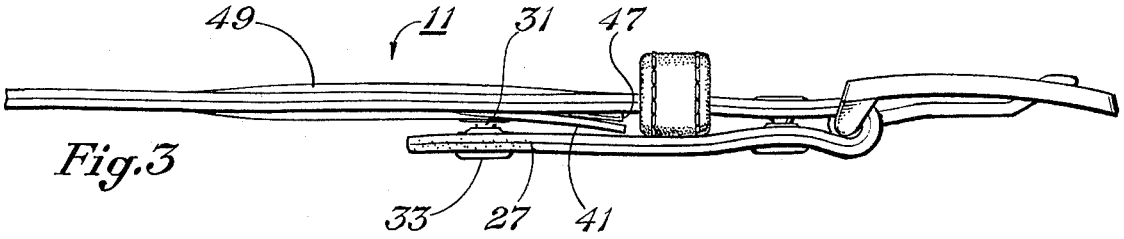
FIG. 3 is another view of the belt shown in FIG. 2, reduced in size, with the concealed pocket in the closed position.

An opening or slit 37 that extends only through the inner ply 15, is located near loop 19 adjacent or across from the doubled-back portion 27. Slit 37 does not lie in a single transverse plane of the belt 11 length, rather is preferably curved into a generally "C" shaped configuration. The portion of slit 37 closest to loop 19 is substantially perpendicular to the length of the belt, and the outer ends 39 of slit 37 diverge at a small angle. The outer ends 39 terminate at a distance selected to be less than the length of the doubled-back portion 27. Slit 37 is fully covered when the doubled-back portion is snapped in place parallel to the length of the belt 11 as shown in FIG. 3.

The arcuate boundries of the slit 37 define a flap 41. Snap 31 is located at approximately the fold or base 43 of flap 41. Slit 37 provides access to the interior space 45 between the inner and outer plies 15, 13. Small articles, such as money, indicated schematically as 47, may be inserted into space 45, with flap 41 covering the end portion of the article 47.

To insert article 47 into the belt, the doubled-back portion 27 is released at fasteners 31, 33 and drawn back. Flap 41 is pulled back and the article 47 inserted or removed. Doubled-back portion 27 is then resnapped so as to provide a substantially flat end portion of the belt. Depending on the thickness of the article 47, a slight, but normally unnoticeable bulge, indicated at 49, may exist.

It should be apparent that an invention having significant improvements has been provided. A concealed pocket is provided without the need for additional stitching. The pocket has little, if any, tendency to bulge, and is readily accessible. Articles are retained within the interior space or pocket by the releasably fastened doubled-back portion, even when the belt is removed.

While the invention has been shown in only one of its forms, it should be apparent to those skilled in the art that it is not so limited but is susceptible to various changes and modifications without departing from the spirit thereof.

I claim:

1. An improved apparel belt having inner and outer plies extending the length of the belt, and a doubled-back portion of the inner and outer plies at one end, defining a loop for retaining a buckle, the improvement comprising:

the inner ply having a slit near the doubled-back portion to provide access to the space between the inner and outer plies for placing articles; the slit not lying in a single plane, with the portion within the bounds of the slit defining a flap; and fastening means for releasably fastening the doubled-back portion to the flap for selectively closing and providing access to the space between the inner and outer plies.

2. The apparatus according to claim 1 wherein the slit is arcuate.

3. The apparatus according to claim 1 wherein the fastening means is fastener with a snap and a receptacle located selectively on the base of the flap and on the doubled-back portion.

4. An improved apparel belt having inner and outer plies extending the length of the belt and stitched together at the sides, the inner ply being in contact with the body of the wearer; and a doubled-back portion of the inner and outer plies at one end, defining a loop for retaining a buckle, the improvement comprising:

the inner ply having a curved slit across from the doubled-back portion, to provide access between the inner and outer plies for placing articles, the outer ends of the slit extending towards the end opposite the doubled-back portion a selected distance to define a flap for providing access to the ends of articles inserted into the space between the inner and outer plies; and releasable fastening means located on the flap and the inner layer of the doubled-back portion.

* * * * *